US006109768A

United States Patent [19]

Schuster et al.

[11] Patent Number: 6,109,768

[45] Date of Patent: Aug. 29, 2000

[54] ILLUMINATION DEVICE FOR VEHICLE

[75] Inventors: Kurt Schuster, Reutlingen; Gerd Bahnmueller, Holzgerlingen; Doris Boebel, Stuggart, all of Germany

[73] Assignee: Robert Bosch GmbH, Stuttgart, Germany

[21] Appl. No.: 09/080,426

[22] Filed: May 18, 1998

[30] Foreign Application Priority Data

Jul. 30, 1997 [DE] Germany ..... 197 32 742

[51] Int. Cl.[7] ..... F21V 7/00

[52] U.S. Cl. ..... 362/307; 362/516; 359/839

[58] Field of Search ..... 362/496, 516, 362/521, 307, 327, 329; 359/839

[56] References Cited

U.S. PATENT DOCUMENTS 4,555,748 11/1985 Bradley ..... 362/61

4,577,260 3/1986 Tysoe ..... 362/61

FOREIGN PATENT DOCUMENTS 33 36 178 A1 4/1985 Germany .

*Primary Examiner*—Cassandra Spyrou
*Assistant Examiner*—Mark A. Robinson
*Attorney, Agent, or Firm*—Michael J. Striker

[57] ABSTRACT

An illumination device for a vehicle has a light source, a reflector which reflects a light emitted by the light source so that the reflected light exits the illumination device in a first light outlet direction, the reflector being interrupted at least in one region, and at least partial light-permeable element arranged in the region and formed so that the light emitted by the light source passes through the light-permeable element and exits the illumination device in a second light outlet direction which deviates from the first light outlet direction.

11 Claims, 2 Drawing Sheets

ILLUMINATION DEVICE FOR VEHICLE

BACKGROUND OF THE INVENTION

The present invention relates to an illumination device for a vehicle.

Illumination devices formed as a blinking light are known in the art and disclosed for example in the German document DE 33 36 178 A1. This illumination device has a light source and a reflector which reflects the light emitted by the light source in a light outlet direction of the illumination device. The light outlet direction of the illumination device is substantially the traveling direction of the vehicle. When additionally also a light emission in a direction which deviates from the light outlet is needed, there are difficulties in the use of the light emitted by the light source. For example there are provisions in accordance with which the visibility of the light emitted by a front blinking light in lateral direction is needed. In order to satisfy these requirements, separate illumination devices for lateral light outlet direction are utilized which correspondingly are expensive.

SUMMARY OF THE INVENTION

Accordingly, it is an object of the present invention to provide an illumination device for a vehicle of the above mentioned general type, which avoids the disadvantages of the prior art.

In keeping with these objects and with others which will become apparent hereinafter, one feature of present invention resides, briefly stated, in an illumination device for a vehicle, in which the reflector has at least a region in which it is interrupted and in this region at least one partially light-permeable element is arranged so that the light emitted by the light source extends through the element and can exit the illumination device in a second lateral light outlet direction which deviates from the first light outlet direction.

When the device is designed in accordance with the present invention, the light emitted by the light source exits the illumination device through the interrupted region of the reflector and the light-permeable element in the second light outlet direction as well.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
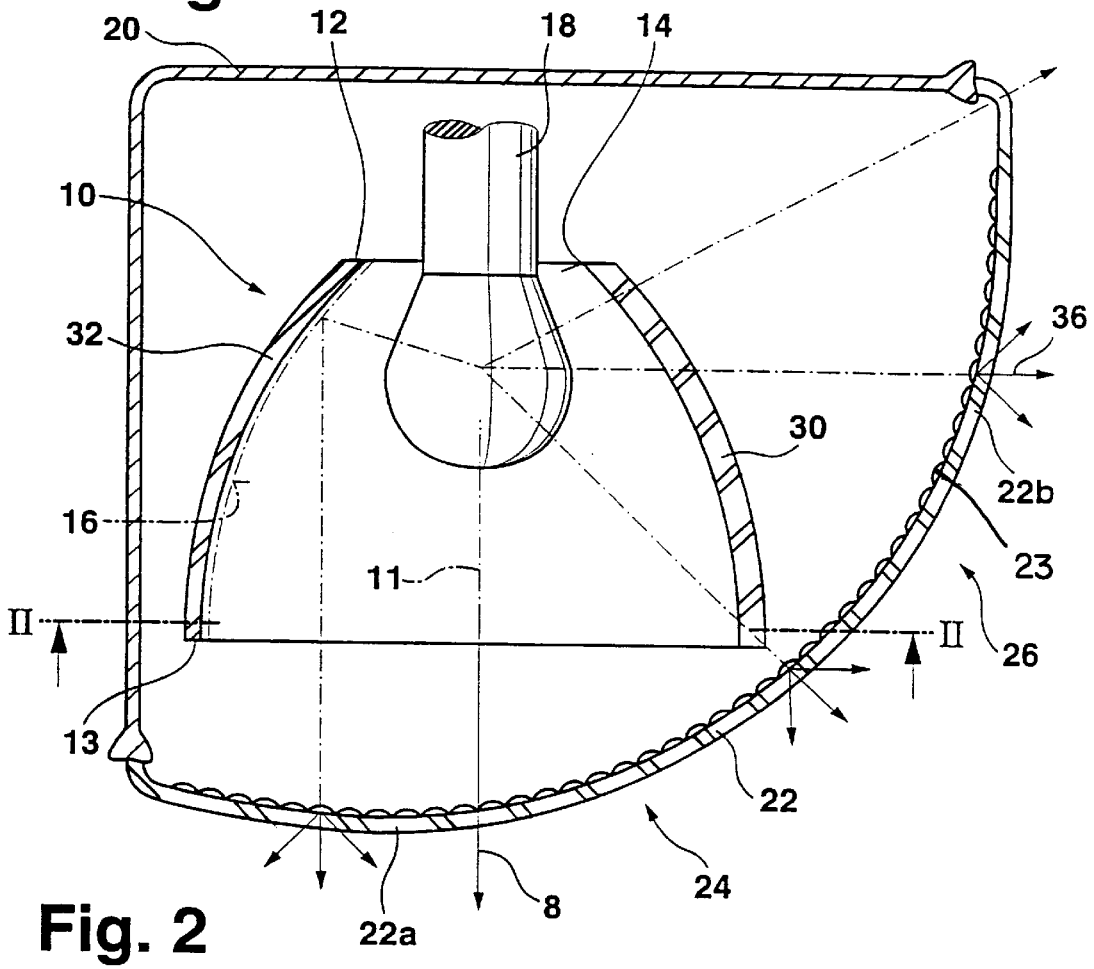
FIG. 1 is a view showing a horizontal longitudinal section of an illumination device in accordance with the present invention.

An illumination device for a vehicle shown in FIGS. 1–6 operates for example as a front blinking light of a motor vehicle which can be arranged laterally near a headlight. The illumination device has a reflector 10 which is curved concavely and has an apex 12 with an opening 14 in the apex. At least the inner surface of the reflector 10 is provided with a reflecting coating 16.

A light source 18 is inserted in the opening 14 of the reflector 10, which can be formed for example as an incandescent lamp. The reflector 10 with the light source 18 can be arranged in the housing 20, whose light outlet opening is covered with a light-permeable member 22. The light-permeable member or disk 22 can be substantially smooth, or can be provided at least locally with optically active profile for deviating and/or dispersing the light emitted by the light source 18 and reflected by the reflector 10 during passage through such a cover member. The cover member 22 can be colorless or can be colored with the signal color required for the illumination device. The cover member 22 can be composed of glass or synthetic plastic material. Alternatively, the reflector 10 itself can form a housing of the illumination device, and the cover member 22 is then connected with the front edge 13 of the reflector 10.

The illumination device has a front region 24 facing substantially in a traveling direction 8 of the vehicle, and a lateral region 26 extending substantially transversely to the traveling direction 8 toward the outer side of the vehicle. With the reflector 10, the light emitted by the light source 18 can reflect substantially in the traveling direction 8 and passes through a front portion 22*a* of the cover member 22. The reflector 10 can have for example at least approximately parabolic shape, so that the light emitted by light source 18 is reflected parallel to the optical axis 11 of the light outlet direction 8. Alternatively, the reflector 10 can have any other shape, so that the light emitted by the light source 18 can be reflected in a predetermined direction and with a predetermined dispersion. The traveling direction 8 substantially corresponds to the light outlet direction of the reflector 10. The light exiting the illumination device can also have a horizontal and/or vertical dispersion, or when it is prescribed, can extend not directly in the traveling direction 8.

Figure 2:
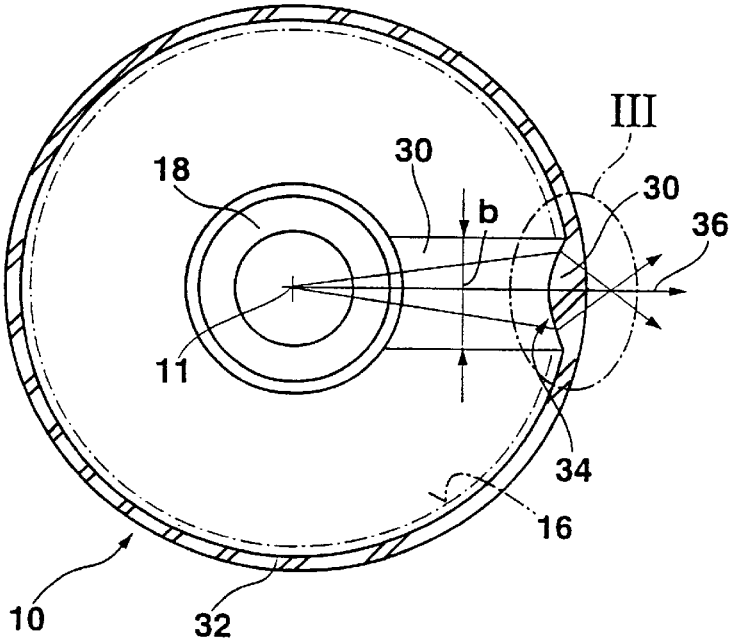
FIG. 2 is a view showing a section taken along the line II—II through the illumination device in FIG. 1 in accordance with the first embodiment.
Figure 3:
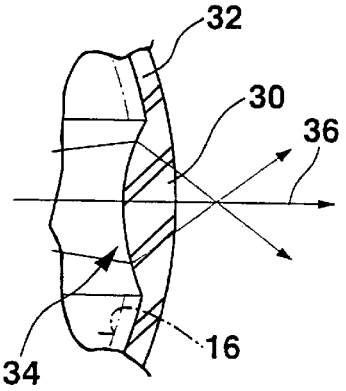
FIG. 3 is a view showing a portion III of FIG. 1 in the illumination device on an enlarged scale.

In accordance with the present invention, the reflector 10 has at least one lateral region in which it is interrupted. In FIGS. 1–3 the reflector 10 is shown in accordance with the first embodiment, in which the reflector 10 is provided with an interrupted region 30 in the peripheral region which faces the lateral outer side of the vehicle. The region 30 extends in the apex 12 and the front edge 13 of the reflector 10 over a part of the periphery of the reflector 10. The region 30 can be formed so that it is extends only over a part of the extension of the reflector 10 in direction of the optical axis 11 and not up to the apex 12 and/or to the front edge 13 of the reflector 10. The region 30 can have a substantially constant width b over its longitudinal extension in direction of the optical axis 11 of the reflector 10, or alternatively the width b of the region 30 can change over the longitudinal extension. For example it can change so that the width b, starting from the apex 12, increases toward the front edge 13 of the reflector 10.

In the first embodiment of the illumination device, the reflector has a base body 32 which is composed at least in the region 30 of a light-permeable material and forms a light-permeable element. Preferably, the whole base body 32 is composed of a light-permeable material, such as for example heat resistant synthetic plastic or glass. The base body 32 can be composed for example of PMMA (polymethylmethacrylate), PC (polycarbonate) or AP (aromatic modified polycarbonate). The reflecting coating 16 is applied at least on the inner surface of the base body 32, however the region 30 has no coating and thereby is light-permeable. The base body 32 in the region 30 has at least one optically active profile 34 which, as shown in the embodiment of FIGS. 2 and 3, forms at least approximately a cylindrical lens. It has a convex curvature toward the interior to the optical axis 11 of the reflector 10. The longitudinal extension of the profile 34 approaches in direction of the optical axis 11 of the reflector 10 correspodingly the curvature of the reflector 10, and in substantially horizontal planes. The curvature of the optical profile 34 can be substantially circular-arc-shaped or have any other shape.

The light exiting the lateral region 30 extends through the lateral portion 22*b* of the cover member 22 and in a direction 36 substantially perpendicular to the light outlet direction 8 of the illumination device. Due to the optical profile 34, the light emitted by the light source disperses during passage in a vertical direction, so that it illuminates the lateral portion 22*b* of the cover member 22 substantially over its whole expansion in a vertical direction. In a horizontal direction, the light passing through the region 30 is not influenced. In general, the optical profile 34 is formed so that the light emitted by the light source 18 is deviated by the profile 34 so that it passes through a maximum possible part of the lateral part 22*b* of the cover member 22 and thereby can exit the illumination device. The cover member 22 can be provided at its lateral region 22*b* with an optically effective profile 23. With the profile 23, the light passing through the region 30 is dispersed in horizontal and/or vertical direction to provide a predetermined or prescribed visibility of the light in different lateral directions deviating from the light outlet direction 36.

In deviation from the above described embodiment of the illumination device, it is also possible that the coating 16 is applied in the region 30 of the reflector 10, but however it is partially light-permeable and partially reflected. This can be achieved for example when the coating 16 in the region 30 is applied with a thickness which is smaller than the coating in the remaining reflector 10. Alternatively, the region 30 of the reflector 10 can be provided with a different coating than the remaining portion of the reflector 10.

Figure 4:
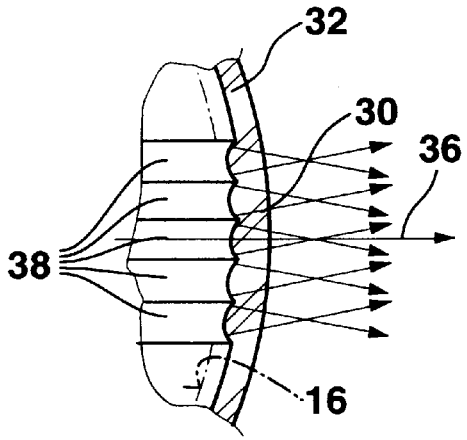
FIG. 4 is a view showing a portion III of a first modified embodiment of the illumination device.

FIG. 4 shows an embodiment of the reflector device, in which, in contrast to the first embodiment, the construction of the base body 32 in the lateral region 30 is modified. The region 30 has several optical profiles 38 which are offset in a vertical direction relative to one another and form as least partially a cylindrical lens. The optical profile 38 extend with their longitudinal extension each at least approximately in direction of the optical axis 11 of the reflector 10 in correspondence with the curvature of the reflector 10 and each in a substantially horizontal plane. The optical profile 38 has a convex curvature relative to the optical axis 11 which at least approximately is circular-arc-shaped or formed in a different way. The curvatures of the individual optical profiles 38 can be different, and the curvatures can be adjusted to the direction in which the light emitted by the light source 18 enters the profile 38. With the optical profile 38, the light emitted by the light source 18 during passage is dispersed in a vertical direction so that it passes through a maximum possible part of the lateral portion 22*b* of the cover disk 22 and exits in direction 36 from the illumination device.

Figure 5:
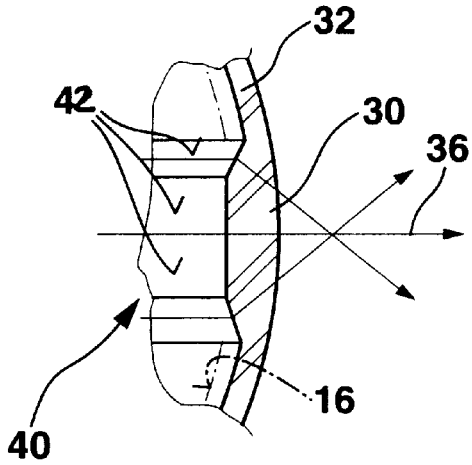
FIG. 5 is a view showing a portion III of a second modified embodiment of the illumination device.

FIG. 5 shows a further embodiment of the illumination device which, contrary to the first embodiment has a construction of the base body 32 in the lateral region 30 which is modified. The region 30 has several optical profiles 40 which are formed each at least approximately at a prism with surfaces 42 facing the optical axis 11. The surfaces 42 are formed so that in the sections perpendicular to the optical axis 11 of the reflector they are formed by straight lines, while in the sections which contain the optical axis 11 they are formed as curved lines corresponding to the curvature of the reflector 10. The surfaces 42 of the optical profiles 40 are oriented generally so that the light passing through them is deviated in a vertical direction so that it passes through a maximum possible part of the lateral portion 22*b* of the cover disk 22 and exits the illumination device in direction 36.

Figure 6:
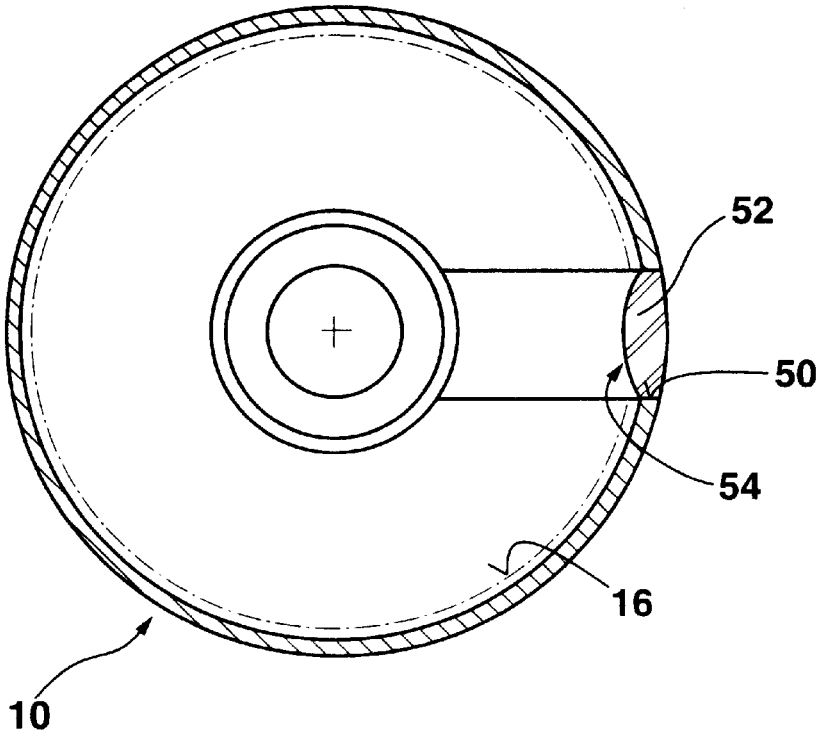
FIG. 6 is a view showing an illumination device in a section taken along II—II in FIG. 1 in accordance with a second embodiment.

FIG. 6 shows the illumination device in accordance with a second embodiment, in which contrary to the first embodiment, the reflector 10 in the interrupted lateral region 30 has an opening 50 with a light-permeable element inserted into it and formed as an insert 42 of light-permeable material. The reflector 10, contrary to the first embodiment, does not have to be provided with a base body composed of a light-permeable material. Instead, it can be composed of a light-permeable synthetic plastic or metal. The insert 52 can be composed of synthetic plastic or glass and connected with the reflector 10 for example by glueing or in a different way. The insert 42 has at least one optically active profile 54 which can be formed as in the embodiment of FIGS. 2–5 and can have the same action as in these figures. In FIG. 6 the optical profile 54 is formed as a cylindrical lens which corresponds to the cylindrical lens 34 of the embodiment of FIGS. 2 and 3.

The above described embodiments can be modified so that the reflector 10 can have not only one interrupted region but several interrupted regions 30, and a respective light-permeable element is arranged in each region. These several lateral regions 30 can be distributed over the periphery of the reflector 10 and/or distributed in direction of the optical axis 11 of the reflector 10.

It will be understood that each of the elements described above, or two or more together, may also find a useful application in other types of constructions differing from the types described above.

While the invention has been illustrated and described as embodied in illumination device for vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An illumination device for a vehicle, comprising a light source; a reflector which reflects a light emitted by said light source so that the reflected light exits the illumination device in a first light outlet direction which corresponds to a traveling direction of the vehicle, said reflector being interrupted at least in one lateral region; and at least partially light-permeable element arranged in said lateral region and formed so that the light emitted by said light source passes through said at least partially light-permeable element and exits the illumination device in a second lateral light outlet direction which deviates from said first light outlet direction.

2. An illumination device as defined in claim 1, wherein said at least partially light-permeable element has at least one optically active profile which disperses the light passing through said at least partially light-permeable element at least in a vertical direction.

3. An illumination device as defined in claim 2, wherein said at least one optically active profile is formed at least approximately as a cylindrical lens.

4. An illumination device as defined in claim 2, wherein said at least one optically active profile is formed at least approximately prism-shaped.

5. An illumination device as defined in claim 2, wherein said at least partially light-permeable element is provided with a plurality of optically active profiles which are distributed in a peripheral direction of said reflector.

6. An illumination device as defined in claim 1, wherein said at least one lateral region of said reflector extends over a part of a periphery between an apex of said reflector and a front edge of said reflector which faces said first light outlet direction.

7. An illumination device as defined in claim 1, wherein said reflector in said at least one lateral region has an opening, said at least partially light-permeable element being formed as an insert of a light-permeable material inserted in said opening.

8. An illumination device as defined in claim 1, wherein said reflector has a base body composed at least locally of a light-permeable material; and further comprising a reflection layer applied on said base body but in said at least one lateral region of said reflector no reflection layer is applied, said lateral light permeable element being formed by said base body.

9. An illumination device as defined in claim 1, wherein said reflector has a base body composed at least locally of a light-permeable material; and further comprising a reflection layer applied on said base body, and in said at least one lateral region said reflection layer is partially reflecting and partially light-permeable, said lateral light permeable element being formed by said base body.

10. An illumination device as defined in claim 1, wherein the illumination device forms a front blinking light, said first light outlet direction substantially corresponding to a traveling direction of the vehicle, said at least one lateral region being arranged in a peripheral region of said reflector facing an outer side of the vehicle, said second light outlet direction being substantially transverse to the traveling direction and extending to the lateral outer side of the vehicle.

11. A vehicle, comprising a vehicle body; and an illumination device formed as a front light, said illumination device including a light source, a reflector which reflects a light emitted by said light source so that the reflected light exits the illumination device in a first light outlet direction, said reflector being interrupted at least in one lateral region, and at least partial light-permeable element arranged in said lateral region and formed so that the light emitted by said light source passes through said light-permeable element and exits the illumination device in a second lateral light outlet direction which deviates from said first light outlet direction, said first light outlet direction substantially corresponding to a traveling direction of said vehicle body, said at least one uninterrupted region being arranged in a lateral peripheral region of said reflector facing an outer lateral side of said vehicle body, said second light outlet direction being substantially transverse to said traveling direction and extending toward said outer lateral side of said vehicle.

* * * * *